US010352108B2

(12) United States Patent
Ardila

(10) Patent No.: US 10,352,108 B2
(45) Date of Patent: Jul. 16, 2019

(54) MILL CATCH MECHANISM

(71) Applicant: Schlumberger Technology Corporation, Sugar Land, TX (US)

(72) Inventor: Jaime Ardila, Abu Dhabi (AE)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 104 days.

(21) Appl. No.: 15/092,676

(22) Filed: Apr. 7, 2016

(65) Prior Publication Data

US 2016/0305195 A1 Oct. 20, 2016

Related U.S. Application Data

(60) Provisional application No. 62/147,118, filed on Apr. 14, 2015.

(51) Int. Cl.
*E21B 17/04* (2006.01)
*E21B 29/06* (2006.01)

(52) U.S. Cl.
CPC ..... *E21B 17/04* (2013.01); *E21B 29/06* (2013.01)

(58) Field of Classification Search
CPC ..... E21B 17/04; E21B 17/06; E21B 29/06
See application file for complete search history.

(56) References Cited

U.S. PATENT DOCUMENTS 1,899,728 A * 2/1933 Sandstone ..... E21B 4/06 175/232
2,657,016 A * 10/1953 Grable ..... E21B 10/04 175/206
3,112,800 A * 12/1963 Bobo ..... E21B 7/18 175/217
2014/0251615 A1* 9/2014 Donovan ..... E21B 29/06 166/298
2017/0089399 A1* 3/2017 Gharib ..... F16D 1/0876

* cited by examiner

*Primary Examiner* — Giovanna C Wright
*Assistant Examiner* — Yanick A Akaragwe

(57) ABSTRACT

Systems, tools, and methods include using a milling assembly with a catch mechanism configured to maintain a connection between the drill string and the mill in the event a primary connection between the mill and catch mechanism fails. A primary connection may support the weight of the mill by using a connection between the drill string and the mill. The catch mechanism may operate as a back-up or redundant connection and may support the weight of the mill by coupling the catch mechanism to both the mill and the drill string.

17 Claims, 6 Drawing Sheets

MILL CATCH MECHANISM

CROSS-REFERENCE TO RELATED APPLICATIONS

This application claims the benefit of, and priority to, U.S. Patent Application Ser. No. 62/147,118, filed Apr. 14, 2015, which application is expressly incorporated herein by this reference in its entirety.

BACKGROUND

In the production of hydrocarbons, a wellbore may be drilled to target a zone of interest in which oil or gas is thought to be located. After the wellbore is drilled, casing may be installed in the wellbore. The casing may provide structural integrity to the wellbore and isolate the wellbore to prevent fluids in portions of the formation from flowing into the wellbore, and to prevent fluids from the wellbore from flowing out into the formation. Casing may be formed of strings of steel or other metallic tubulars which line the wellbore. Cement may be pumped into an annular region around the outer surface of the casing and allowed to cure to set the cement and secure the casing in place.

Portions of casing may be removed in order to facilitate certain downhole operations such as fracturing, sidetracking, slot recovery, and wellbore abandonment. For instance, in sidetracking, a whipstock may be anchored in the wellbore and a mill may be tripped into the wellbore. The mill may be pushed by the whipstock into the casing. By rotating the mill, the mill may cut and mill away a portion of the casing to form an opening or window. A drill bit may then be extended into the wellbore and through the window in the casing in order to begin drilling a deviated or other lateral borehole. In a slot recovery or wellbore abandonment operation, a section mill may be inserted into the wellbore. The section mill may include blades that expand outward and contact the casing. As the section mill is rotated and moved longitudinally within the wellbore, a section of casing may be removed within the wellbore.

SUMMARY

Embodiments of the present disclosure may relate to tools and methods for using tools. An example tool, for instance, may include a bit and a first load path coupled to the bit. The first load path may be designed to a weight of the bit. The tool may also include a second load path. The second load path may also be coupled to the bit and designed to support at least the weight of the bit.

According to another embodiment, a tool may include a downhole tool having a bit and a drill string with a distal end coupled to the bit. A catch mechanism may be coupled to the bit and designed to support the bit when the drill string fails or when a connection between the drill string and the bit fails.

In accordance with another embodiment, a method for retrieving a downhole tool may include tripping a downhole tool into a wellbore. The downhole tool may include a bit and a drive mechanism coupled to the bit. A catch mechanism may also be coupled to the bit. A downhole operation may be performed with the downhole tool while the drive mechanism supports the bit. The downhole tool may then be tripped out of the wellbore.

Yet another embodiment of the present disclosure may relate to a milling assembly that includes a mill and a drill string coupled to the mill. The mill may support a full weight of the mill. The milling assembly may also include a catch mechanism coupled to the mill. The catch mechanism may be designed to support a full or partial weight of the mill after failure of a connection between the mill and the drill string.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each embodiment contemplated hereby, various embodiments will be described and explained with additional specificity and detail through the use of the accompanying drawings in which:

FIG. 3-1 is a cross-sectional view of a downhole tool for performing a milling operation, in accordance with one or more embodiments of the present disclosure;

FIG. 3-2 is a cross-sectional view of the downhole tool of FIG. 3-1, after failure of a primary connection between a drive mechanism and a bit, in accordance with one or more embodiments of the present disclosure;

DETAILED DESCRIPTION

In accordance with some aspects of the present disclosure, embodiments herein relate to milling tools. According to other aspects of the present disclosure, embodiments herein relate to downhole tools. More particularly, some embodiments disclosed herein may relate to downhole tools, milling systems, and bottomhole assemblies that include a mill. An example bottomhole assembly may include a mill for use in a sidetracking, junk milling, fishing, remedial, or other downhole operation. In still other aspects, embodiments of the present disclosure may relate to mill catch mechanisms that allow retrieval of the mill after failure of a primary connection between a mill and a drive or delivery mechanism.

Figure 1:
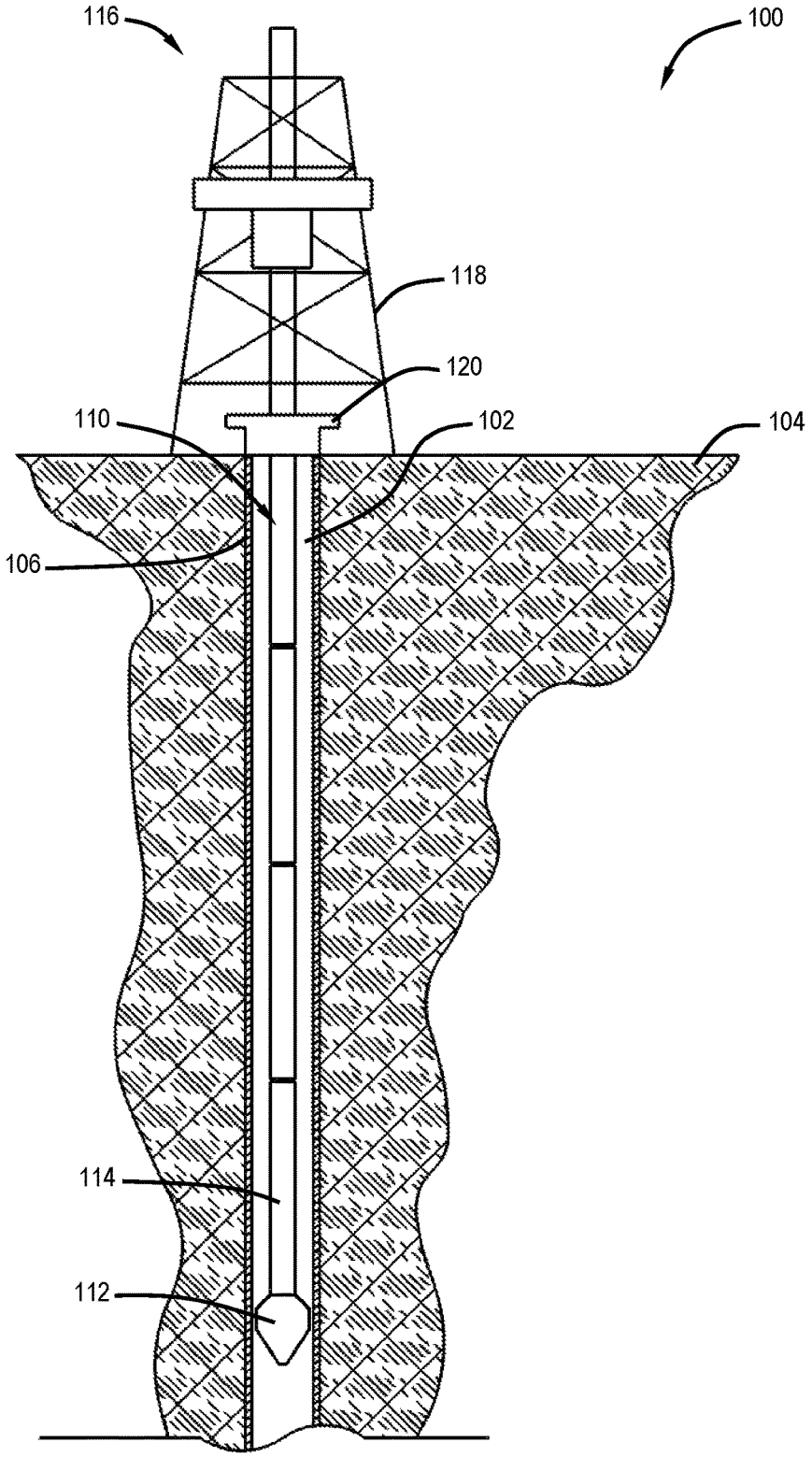
FIG. 1 is a schematic illustration of an example milling system, in accordance with one or more embodiments of the present disclosure.

Referring now to FIG. 1, a schematic diagram is provided of an example milling system 100 that may utilize milling systems, assemblies, devices, and methods in accordance with embodiments of the present disclosure. FIG. 1 shows an example wellbore 102 formed in a formation 104. In this particular embodiment, the wellbore 102 includes a casing 106 installed therein. The casing 106 may extend along a full length of the wellbore 102; however, in other embodiments, at least a portion of the wellbore 102 may be an openhole or uncased wellbore. Casing 106 within the wellbore 102 may include various types of casing, including surface casing, intermediate casing, conductor casing, production casing, production liner, and the like. In some embodiments, as the depth of the wellbore 102 increases, the diameter of the casing 106 may decrease.

In at least some embodiments, the casing 106 may provide structural integrity to the wellbore 102, isolate the wellbore 102 against fluids within the formation 104, or perform other aspects or functions. In some applications, after the casing 106 is cemented or otherwise installed within the wellbore 102, a portion of the casing 106 may be removed to facilitate a downhole operation. In FIG. 1, for instance, a downhole tool 110 may be inserted into the wellbore to remove a portion of the casing 106. The downhole tool 110 may include a mill 112 coupled to a drill string 114. When the downhole tool 110 includes a mill, the downhole tool 110 may also be considered a milling assembly. The drill string 114 may include sections of drill pipe, transition drill pipe, drill collars, or other drive mechanisms or delivery devices that allow the mill 112 to be tripped into the wellbore 102 for an operation such as milling a portion of the casing 106, drilling formation, etc.

A whipstock (see FIG. 2) may be used to deflect the mill 112 into the casing 106 to form a window therein. In such an embodiment, the mill 112 may be a window mill, taper mill, lead mill, or the like. The mill 112 may also include additional components such as dress mills, follow mills, stabilizers, other components, or combinations of the foregoing. After formation of the window, a drill string with a drill bit (not shown) may be tripped into the wellbore 102 and pass through the window to form a lateral borehole.

The downhole tool 110 may also be used for additional or other downhole operations. The mill 112 may, for instance, be a mill and drill bit and may be used in the sidetracking operation, potentially without the use of a separate drill bit. The mill 112 may include a junk mill or other similar tool to cut, mill, and grind up tools, debris, or other items found within the wellbore 102 or a lateral borehole. For instance, a bridge plug (not shown) may be set within the wellbore 102, and the mill 112 may be used to grind up the bridge plug to open fluid flow between upper and lower zones within the wellbore 102. The mill 112 may also be another type of bit (e.g., a drill bit) and usable to perform drilling operations on the formation 104 rather than milling operations on the casing 106 or other components in the wellbore 102.

In the particular embodiment illustrated in FIG. 1, the downhole tool 110 may be provided to facilitate a milling operation. The mill 112 may be part of a bottomhole assembly connected to the drill string 114. In FIG. 1, the drill string 114 is illustrated as extending from the surface and having the bottomhole assembly or mill 112 at the distal end thereof. The drill string 114 may include one or more tubular members. The tubular members of the drill string 114 may themselves have any number of configurations. As an example, the drill string 114 may include segmented/jointed drill pipe or wired drill pipe. Such drill pipe may include rotary shouldered or other threaded connections on opposing ends to allow segments of drill pipe to be coupled together to increase the length of the drill string 114 as the mill 112 is tripped further into the wellbore 102, or disconnected to shorten the length of the drill string 114 as the mill 112 is tripped out of the wellbore 102. The drill string 114 may also include continuous components such as coiled tubing. Couplings, drill collars, transition drill pipe, stabilizers, and other drill string and bottomhole assembly components known in the art, or combinations of the foregoing, may also be used.

To use the mill 112 for a downhole operation, uphole or downhole rotational power may be provided to rotate the mill 112. A drilling rig 116, for instance, may be used to convey the drill string 114 and mill 112 into the wellbore 102. In an example embodiment, the drilling rig 116 may include a derrick and hoisting system 118, a rotating system, a mud circulation system, or other components. The derrick and hoisting system 118 may suspend the downhole tool 110, and the drill string 114 may pass through a wellhead 120 and into the wellbore 102. In some embodiments, the drilling rig 116 or derrick and hoisting system 118 may include a draw works, a fast line, a crown block, drilling line, a traveling block and hook, a swivel, a deadline, other components, or some combination of the foregoing. An example rotating system may be used, for instance, to rotate the drill string 114 and thereby also rotate the mill 112 or other components of the downhole tool 110. The rotating system may include a top drive, kelly, rotary table, or other components that can rotate the drill string 114 at or above the surface. In such an embodiment, the drill string 114 may be a drive mechanism for use in driving, or rotating, the mill 112.

In other embodiments, the mill 112 may be rotated by using a downhole component. For instance, the downhole tool 110 may include a downhole motor as discussed herein. The downhole motor may operate as a drive mechanism and may include any motor that may be placed downhole, and expressly may include a mud motor, turbine motor, other motors or pumps, any component thereof, or any combination of the foregoing. A mud motor may include fluid-powered motors such as positive displacement motors ("PDM"), progressive cavity pumps, Moineau pumps, other type of motors, or some combinations of the foregoing. Such motors or pumps may include a helical or lobed rotor that is rotated by flowing drilling fluid. The drill string 114 may include coiled tubing, slim drill pipe, segmented drill pipe, or other structures that include an interior channel within a tubular structure so as to allow drilling fluid to pass from the surface to the downhole motor. In the mud motor, the flowing drilling fluid may rotate the lobed rotor relative to a stator. The rotor may be coupled to a drive shaft which can directly or indirectly be used to rotate the mill 112. In the same or other embodiments, the motor may include turbines. A turbine motor may be fluid-powered and may include one or more turbines or turbine stages that include a set of stator vanes that direct drilling fluid against a set of rotor blades. When the drilling fluid contacts the rotor blades, the rotor may rotate relative to the stator and a housing of the turbine motor. The rotor blades may be coupled to a drive shaft (e.g., through compression, mechanical fasteners, etc.), which may also rotate and cause the mill 112 to rotate.

Although the milling system 100 is shown in FIG. 1 as being on land, those of skill in the art will recognize that embodiments of the present disclosure are also equally applicable to offshore and marine environments. Additionally, while embodiments herein discuss milling operations within a cased wellbore, in other embodiments, aspects of the present disclosure may be used in a milling or drilling operation in an openhole wellbore, or an openhole section within a wellbore. Further still, milling or drilling systems may be used in accordance with some embodiments of the present disclosure above the surface rather than in a downhole environment.

Figure 2:
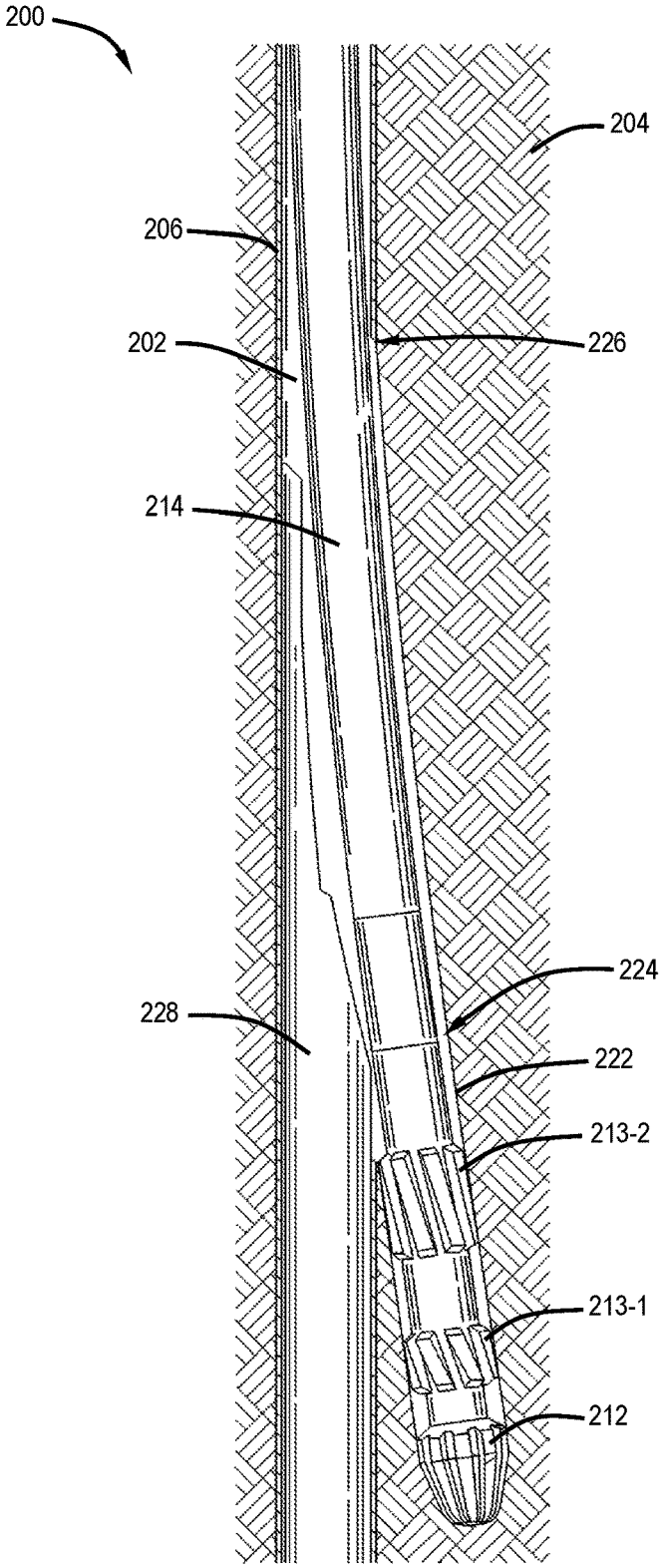
FIG. 2 is a partial cross-sectional view of a milling system during a sidetracking operation, in accordance with one or more embodiments of the present disclosure.

With reference now to FIG. 2, another example of a milling system 200 is shown in additional detail. In particular, the milling system 200 is shown as being configured for use in a sidetracking operation during which a downhole tool 210 may be tripped into a primary wellbore 202 and used to form a deviated or other lateral borehole 222 branching off from the primary wellbore 202.

More particularly, in the illustrated embodiment, the downhole tool 210 may include a bottomhole assembly 224 coupled to a drill string 214. The drill string 214 and bottomhole assembly 224 may be tripped into the primary wellbore 202, which may have casing 206 installed therein. The bottomhole assembly 224 may include one or more mills configured to mill away a portion of the casing 206 and form a window 226 through the casing 206, so as to expose the wellbore 202 to the formation 204. Examples of mills that may be included on the bottomhole assembly 224 include a lead mill 212 (or window mill or taper mill), a follow mill 213-1, a dress mill 213-2, a watermelon mill, other mills, or any combination of the foregoing.

In the illustrated embodiment, the lead mill 212 may be located at the distal or downhole end of the bottomhole assembly 224. The lead mill 212 may be deflected into the casing 206 by a whipstock 228 or other deflection member within the wellbore 202. The lead mill 212 may initially mill into the casing 206 to initiate formation of the window 226, and may subsequently drill partially into the formation 204. The follow mill 213-1 and the dress mill 213-2 may then pass through the window 226. In some embodiments, the follow mill 213-1 and the dress mill 213-2 may enlarge the window 226, smooth edges of the casing 206 around the window 226, or perform other functions.

In operation, the downhole tool 210 may be part of a downhole milling system used to form the lateral borehole 222 extending from the primary wellbore 202. The lead mill 212, follow mill 213-1, dress mill 213-2, and the like may be rotated by rotating the drill string 214 from the surface, rotating a drive shaft using a downhole motor, or in any other suitable manner. When weight-on-bit is applied to the bottomhole assembly 224, the lead mill 212, follow mill 213-1, and dress mill 213-2 may be subjected to various loads and forces, including shock or impact loads, torsional loads, shear loads, vibrational (lateral, axial, etc.) loads and fatigue, and the like. In some embodiments, such loads may cause the lead mill 212, the follow mill 213-1, the dress mill 213-2, or connections therebetween, to break and fail. In such an embodiment, the lead mill 212 and potentially other components of the bottomhole assembly 224 could be left downhole while the drill string 214 is tripped out of the wellbore.

To continue formation of the lateral borehole 222, fishing equipment (not shown) may be tripped into the primary wellbore 202 to attempt to catch the lead mill 212 or other components which may remain downhole. Considerable time may be spent in tripping the drill string 214 out of the primary wellbore 202, as well as in in tripping the fishing equipment into the primary wellbore 202, attempting to catch the downhole components, and then tripping out of the primary wellbore 202. In the event the fishing operation is unsuccessful, additional time and resources may be spent in tripping an additional whipstock (not shown) into the primary wellbore 202, anchoring the additional whipstock above the whipstock 228, and using an additional downhole tool to mill a new window above the window 226 to form an additional lateral borehole.

Figures 1, 3:
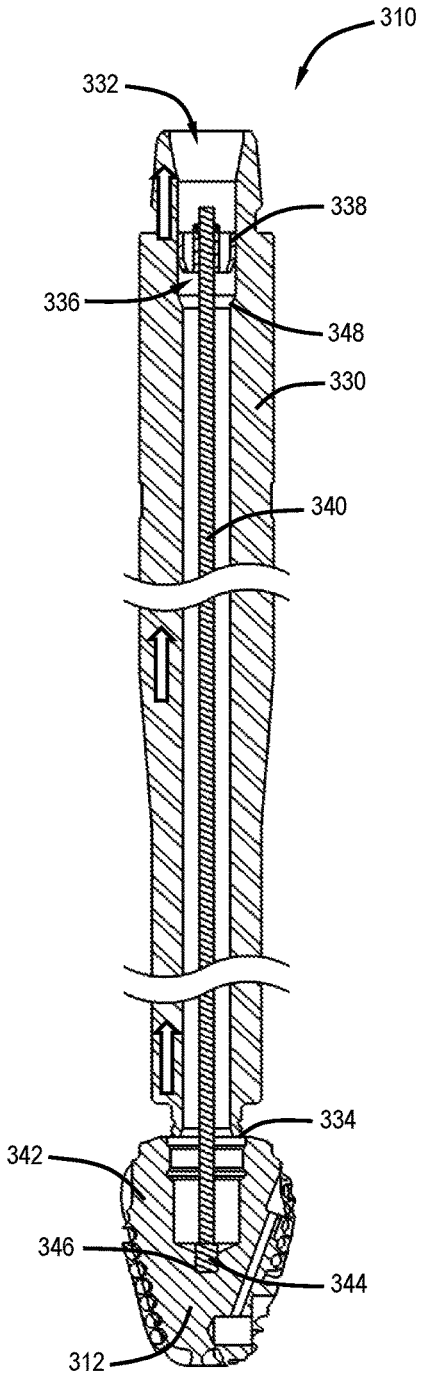
Figures 2, 3:
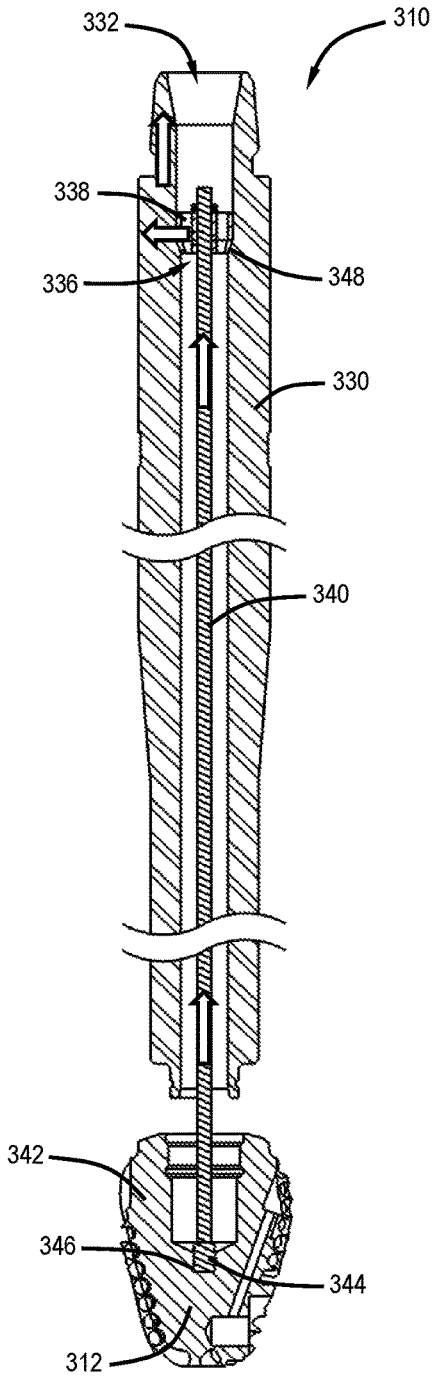
Figure 6:
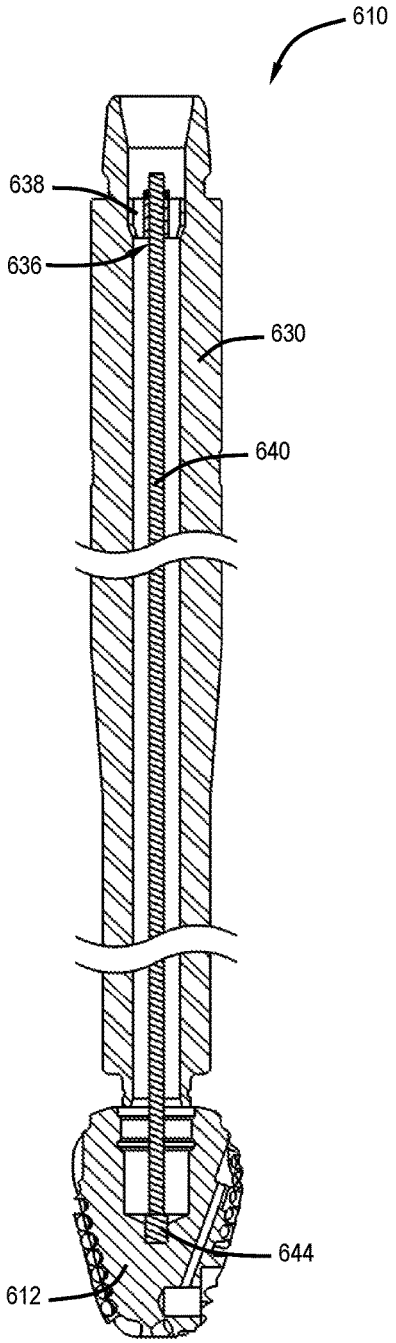
FIG. 6 is a cross-sectional view of still another embodiment of a downhole tool for performing a milling operation, in accordance with one or more embodiments of the present disclosure.

To guard against the expenditure or waste of resources or time in attempting to retrieve components that are broken-off downhole, the downhole tool 210 may, according to some embodiments of the present disclosure, include a catch or retrieval mechanism (see FIG. 3-1 to FIG. 6). An example catch mechanism may be coupled to the drill string 214 or a portion of the bottomhole assembly 224 at a location above a potential break point or other failure location. The catch mechanism may also be coupled to or near the lead mill 212. When tripping into the primary wellbore 202, the drill string 214 and potentially the bottomhole assembly 224 may collectively define a load path from which the lead mill 212, follow mill 213-1, dress mill 213-2, or other components may be suspended or otherwise supported. The same load path may potentially be used when rotating the lead mill 212. If the lead mill 212 breaks from the bottomhole assembly 224, such a load path may be broken. In such a scenario, the catch mechanism may act as a redundant or back-up load path to suspend or otherwise support the lead mill 212, follow mill 213-1, dress mill 213-2, and the like. For instance, the catch mechanism may be coupled to an interior of the drill string 214 and to an interior of the lead mill 212. If a failure location forms between the lead mill and the location where the catch mechanism is coupled to the drill string 214, the catch mechanism may continue to couple the lead mill 212 to the drill string 214 to allow the downhole tool 210 to be tripped out of the primary wellbore 202 without an additional fishing operation.

FIG. 3-1 to FIG. 6 illustrate some example embodiments of milling systems and downhole tools that may include a catch mechanism. The catch mechanisms, milling systems, and downhole tools may be used in connection with a system similar to that shown in FIGS. 1 and 2, or in connection with other downhole or other systems. For instance, a catch mechanism may be used for a drilling system with a roller cone bit, fixed cutter bit, impregnated bit, other drill bits, or combinations of the foregoing. Similar catch mechanism may be used with jars, reamers, anchors, bridge plugs, completion equipment, or other downhole tools and systems where a failure location may form and potentially result in leaving a tool downhole or initiating a fishing operation. Further, such a mechanism may also be used outside of a downhole operation for accessing or producing natural resources. For instance, plumbing tools may include inserting a tool within a pipe or tubing, and manufacturing systems for tubular elements may include boring into solid stock materials. In each case, a catch mechanism may be used to recover tools in the event of a break or failure.

With particular reference to FIGS. 3-1 and 3-2, a downhole tool 310 is illustrated and described in additional detail. In particular, the illustrated downhole tool 310 includes a body 330 coupled to a mill 312. The body 330 may, in some embodiments, include a drill pipe, drill collar, transition drill pipe, or other component of a drill string or bottomhole assembly. Accordingly, the body 330 may be tubular in some embodiments, and may include a bore 332 extending fully or partially therethrough. The bore 332 may allow fluid to pass therethrough. In at least some embodiments, the fluid may pass through the bore 332 to the mill 312. One or more nozzles in the mill 312 may eject the fluid to allow fluid to cool the face of the mill 312 or the cutting elements thereon, to transport cuttings within a wellbore, or to perform other functions.

FIG. 3-1 illustrates an example embodiment of the downhole tool 310 when the mill 312 is suspended or otherwise supported along a first load path that includes the body 330. In such an embodiment, the mill 312 may be coupled to a distal or downhole end of the body 330 by a connection 334. The connection 334 may include a welded connection, a threaded connection, other connections, or combinations of the foregoing. In some embodiments, the connection 334 may couple the mill 312 to the body 330 and provide sufficient strength to allow the weight of the mill 312 to be suspended from the body 330 without failure. In the same or other embodiments, the connection 334 may allow the mill 312 to rotate with the body 330.

In use, the downhole tool 310 may experience a variety of forces, and such forces may cause the connection 334 to break, twist off, or otherwise fail. FIG. 3-2 illustrates an example embodiment in which the connection 334 has failed and the mill 312 has separated from the distal end of the body 330. According to some embodiments of the present disclosure, a catch mechanism 336 or other retainer of the downhole tool 310 may provide a secondary or additional connection between the body 330 and the mill 312. As a result, if the connection 334 fails, the catch mechanism 336 may allow the body 330 and the mill 312 to be collectively removed from a wellbore or other location. In effect, when the connection 334 fails, the load path along the body 330 (shown by the arrows in FIG. 3-1) may no longer support the mill 312. Instead, a load path defined at least partially by the catch mechanism 336 (shown by the arrows in FIG. 3-2) may support the mill 312.

According to at least some embodiments, the load path supporting the mill 312 after failure of the connection 334 may pass through both the body 330 and the catch mechanism 336. For instance, the catch mechanism 336 may be coupled to the body 330 above the connection 334. When the connection 334 fails, the catch mechanism 336 may support the mill 312 and transfer the load to a portion of the body 330. In some embodiments, the catch mechanism 336 may support at least some of the load of the mill 312 when the connection 334 has not failed (e.g., the load path may pass through both the body 330 and the catch mechanism 336). In other embodiments, such as that shown in FIGS. 3-1 and 3-2, the catch mechanism 336 may not support the load of the mill 312 prior to failure of the connection 334 (e.g., the load path may not have any portion passing through the catch mechanism 336), but may support up to a full amount of the load of the mill 312 after failure of the connection 334 (e.g., the load path may pass through the catch mechanism 336).

One manner for allowing the catch mechanism 336 to move between inactive and active states is shown in FIGS. 3-1 and 3-2. In this particular embodiment, the catch mechanism 336 may be located within the bore 332 of the downhole tool 310. More particularly, a retention ring 338 of the catch mechanism 336 may be coupled to an elongate member 340. The elongate member 340 may include, for instance, a rod, tube, wire, cord, cable, or the like. The elongate member 340 may extend through the bore 332 and be coupled to a bit body 342 of the mill 312. For instance, the catch mechanism 336 may include a retention element 344 at or near a distal or downhole end of the elongate member 340. The retention element 344 may be configured to maintain the elongate member 340 coupled to the mill 312. In some embodiments, the retention element 344 may be externally threaded. The bit body 342 may include an opening 346 into which the retention element 344 may be threaded. In the same or other embodiments, the retention element 344 may be coupled to the mill 312 in other manners. For instance, welds, adhesives, pins, friction fits, interference fits, detents, or other connection mechanisms, or combinations of the foregoing, may be used to couple the elongate member 340 to the mill 312.

In some embodiments, the catch mechanism 336 may move axially within the bore 332 to transition between the inactive and active states. For instance, the bore 332 may have a variable diameter. In FIG. 3-1, for instance, the bore 332 may have a shoulder 348 defined therein. At the shoulder 348, the diameter of the bore 332 may be reduced. Optionally, the retention element 344 may be sized to fit within the bore 332 above the shoulder 348, but not below the shoulder 348. For instance, the shoulder 348 may define a restriction within the bore 332, and the restriction may limit or even prevent the retention element 344 from passing downward past the shoulder 348. In the inactive position of the catch mechanism 336 as shown in FIG. 3-1, the retention element 344 may be positioned above the shoulder 348, and optionally not engaged with the shoulder 348. The elongate member 340 may not support a full or partial weight of the mill 312 or other bit in the inactive position. As a result, the elongate member 340 may not be in tension. As the mill 312 breaks away from the body 330, the retention element 344 and the elongate member 340 may move axially downward until the retention element 344 contacts the shoulder 348. As shown in FIG. 3-2, the mill 312 may be separated from the body 330 after movement of the catch mechanism 336, and the elongate member 340 may be in tension as it supports the weight or other load of the mill 312.

The retention ring 338 may be coupled to the elongate member 340 by using mechanical fasteners, welds, friction fits, interference fits, detents, threaded connectors, other connectors, or some combination of the foregoing. Due to the connection between the retention ring 338 and the elongate member 340, the load of the mill 312 may be transferred from the elongate member 340 to the retention ring 338. The retention ring 338 may in turn transfer the load to the body 330 through the shoulder 348. As a result, a second or redundant load path may be defined by the catch mechanism 336 and the mill 312 to support the weight of the mill 312. In some embodiments, the upper surface of the shoulder 348 and the lower surface of the retention ring 338 may have corresponding shapes and configurations. For instance, flat, tapered, curved, or other surfaces may be included so that the retention ring 338 mates with the shoulder 348 to effectively transmit the load through the shoulder 348.

In addition to moving axially within the body 330, the catch mechanism 336 may, in some embodiments, rotate relative to the body 330. For instance, the retention ring 338 may include a journal, bearing, bushing, or other similar component. When the catch mechanism 336 is in an inactive state and the mill 312 is coupled to the body 330 by the connector 334, the mill 312 may not rotate relative to the body 330. Optionally, the elongate member 340 may also not rotate relative to the mill 312. As a result, the elongate member 340 may not rotate relative to the body 330. When the mill 312 is disconnected from the body 330, however, the mill 312 may, in some embodiments, be able to rotate relative to the body 330. In such an embodiment, the retention ring 338 may also allow at least the elongate member 340 to rotate with the mill 312 and relative to the body 330. The retention ring 338 may or may not rotate as well, depending on the configuration thereof. For instance, the retention ring 338 may have a square or hexagonal shape that resists rotation within the bore 332, which may have a similar cross-sectional shape. In other embodiments, the retention ring 338 may be circular and configured to rotate in the bore 332. In some embodiments, the retention element 344 may include a journal, bearing, bushing, or the like to allow relative rotation between the mill 312 and the elongate member 340. In such an embodiment, the retention ring 338, the elongate member 340, or both, may or may not be rotatable relative to the body 330.

Figure 4:
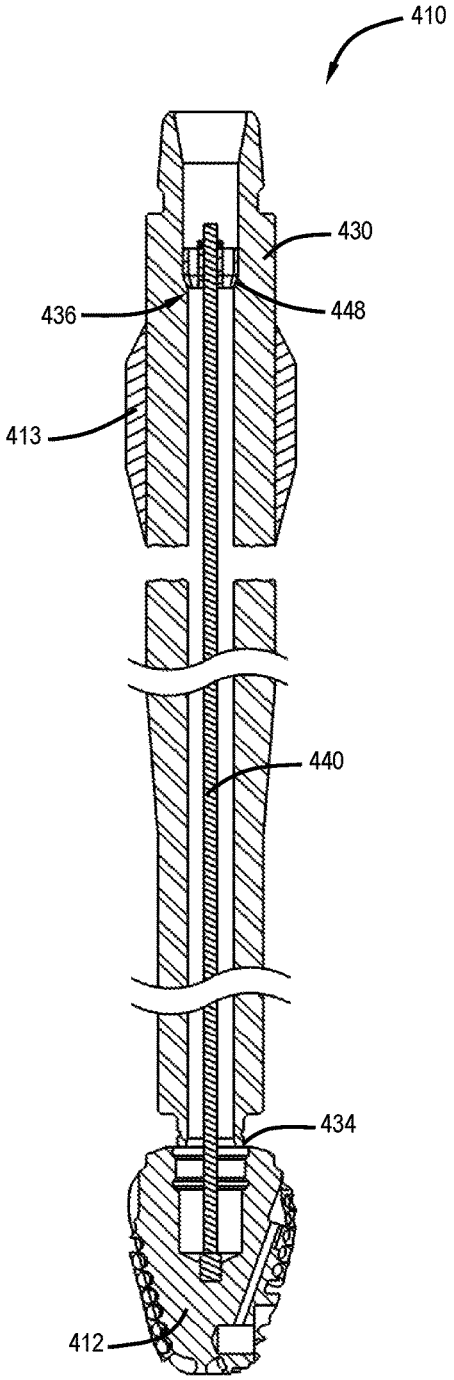
FIG. 4 is a cross-sectional view of another embodiment of a downhole tool for performing a milling operation, after failure of the drive mechanism, in accordance with one or more embodiments of the present disclosure.

Although FIG. 3-2 illustrates the connection 334 as being a failure location in a connection between the mill 312 and the body 330 of a drill string, bottomhole assembly, or other component, the failure location may occur at any other point. FIG. 4, for instance, illustrates a similar embodiment of a downhole tool 410 that includes a body 430 of a drill string, bottomhole assembly, or other component coupled at a distal end thereof to a mill 412 or other bit. A weld, threaded connector, or other connection 434 may be used to couple the mill 412 to the body 430.

FIG. 4 also illustrates the downhole tool 410 as including a catch mechanism 436, which is optionally within the body 430. In this embodiment, the catch mechanism 436 is shown in an active state in which the catch mechanism 436 is supporting the weight of the mill 412, which has been decoupled from at least a portion of the body 430. More particularly, the connection 434 may remain unbroken, and a break may have occurred along the body 430 at a location above the connection 434 but below a shoulder 448 or other connection between the body 430 and the catch mechanism 436. In such an embodiment, the catch mechanism 436 may be in tension and may support the full weight of the mill 412, while also supporting the full weight of the portion of the body 430 below the failure location. Similar to the embodiment shown in FIGS. 3-1 and 3-2, when the catch mechanism 436 is in this active state, a secondary or redundant load path may be defined. Such a load path may pass from the catch mechanism 436 into a portion of the body 430 above the failure location. In contrast, prior to failure of the connection between the body 430 and the mill 412 at the failure location, the catch mechanism 436 may be inactive and the primary load path may include the body 430. More particularly, the primary load path may support the weight of the mill by passing directly through the upper and lower portions of the body 430. Optionally, the catch mechanism 436 may support a fraction of the weight of the mill 412, and potentially no portion of the weight of the mill 412, when the catch mechanism 436 is in the inactive state.

The particular location at which the failure occurs may vary; however, some embodiments of the present disclosure contemplate coupling the catch mechanism 436 to the body 430 at a location that is above a likely failure location. As discussed herein, one failure location may be at an interface or connection between the mill 412 and the body 430. In FIG. 4, the body 430 may be coupled to another downhole component 413. The downhole component 413 may be any number of types of tools or components, including stabilizers, centralizers, mills (e.g., dress mill, follow mill, watermelon mill, section mills, etc.), hardfacing, pressure subs, other components, or some combination of the foregoing. In this embodiment, the failure location may occur adjacent the downhole component 413 (e.g., adjacent in an uphole or downhole direction). Failure at such a location may be particularly likely where, for example, the downhole component 413 places additional stresses on the body 430. For instance, a dress or follow mill may include blades that are welded or brazed to the body 430. The welding or brazing process may weaken the body 430, and lead to an increased likelihood of failure at or near the downhole component 413. Of course, in other embodiments, failure may occur at another location even without a weakened body 430. For instance, stick-slip, whirl, downhole restrictions, or other conditions of the downhole tool 410 or a corresponding wellbore may produce axial or lateral vibrations or loads that may cause failure of the downhole tool 410, thereby decoupling the mill 412 from at least a portion of the body 430 of a drill string, bottomhole assembly, or the like.

Figure 5:
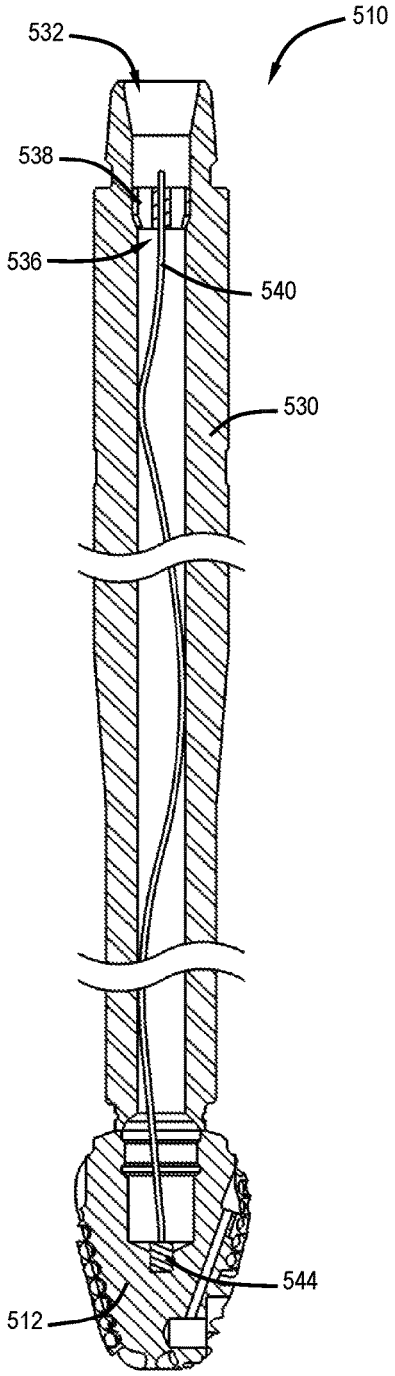
FIG. 5 is a cross-sectional view of another embodiment of a downhole tool for performing a milling operation, in accordance with one or more embodiments of the present disclosure.

In at least some embodiments, the catch mechanism 436 may include an elongate member 440. The elongate member 440 may be a rod, tube, bar, shaft, or other rigid material that is configured to resist bending. In other embodiments, however, the elongate member 440 may take other forms. FIG. 5, for instance, illustrates another embodiment of a downhole tool 510 in which a catch mechanism 536 with a flexible elongate member 540 may be coupled between a mill 512 and a body 530 of a drill string, bottomhole assembly, or other component. In particular, the flexible elongate member 540 may extend fully or partially between a retention ring 538 coupled to the body 530, and a retention element 544 coupled to the mill 512. In the illustrated embodiment, the mill 512 is shown as being coupled to the body 530. The catch mechanism 536 may be in an inactive state as the body 530 may support a full weight of the mill 512. In this embodiment, the retention ring 538 may be located on a shoulder or otherwise positioned, and further downhole or downward movement of the retention ring 538 may be limited or even prevented. The flexible elongate member 540 may be longer than the axial distance between the retention ring 538 and the retention element 544. In such an embodiment, the flexible elongate member 540 may bend or otherwise flex within a bore 532 inside the body 530. Thereafter, if the mill 512 is decoupled from a portion of the body at a location below the retention ring 538, the mill 512 may move axially downward relative to the body 530, and the flexible elongate member 540 may straighten as it is placed under tension. The mill 512 (either alone or with a portion of the body 530 depending on the failure location) may thereby be suspended a distance from an upper or other portion of the body 530.

Some embodiments herein contemplate a catch mechanism that wholly or partially moves axially between inactive and active states. In other embodiments, however, the catch mechanism may not move axially. FIG. 6, for instance, illustrates a downhole tool 610 including a catch mechanism 636 in an inactive state while a body 630 of the downhole tool 610 remains coupled to a mill 612. As shown in FIG. 6, a retention ring 638 may be located at a downhole-most position. An elongate member 640 of the catch mechanism 636 may be rigid or flexible, but the length thereof may be about equal to the length between the retention ring 638 coupling the catch mechanism 636 to the body 630 and a retention element 644 coupling the catch mechanism 636 to the mill 612. As a result, if a break or failure develops along the body 630 or at a connection between the mill 612 and the body 630, there may be little if any axial movement of the catch mechanism 636.

A downhole tool of the present disclosure may include a mill or other bit which may be used to perform a downhole operation, including a milling, drilling, or other operation. During such an operation, drilling fluid may pass through the downhole tool to the mill or other bit. The fluid may be expelled through one or more nozzles therein and used to cool the bit, transport cuttings to the surface, or for other purposes. As discussed herein, some embodiments of the present disclosure contemplate a catch mechanism which may be located within the bore of a downhole tool. The catch mechanism may obstruct at least a portion of the bore, and thus limit flow of the drilling fluid to the mill, bit, or other tool. In some embodiments, the catch mechanism or downhole tool may be configured to allow continued flow of drilling fluid past the catch mechanism to the mill or other tool.

Figure 7:
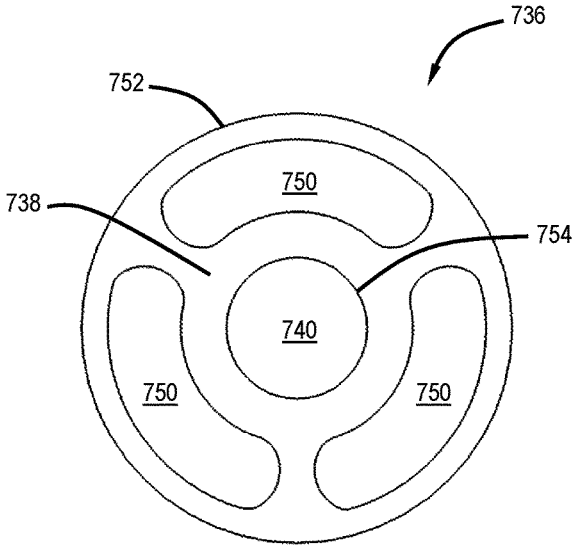
FIG. 7 is a top view of a catch mechanism for use as a secondary connection between a drive mechanism and a bit, in accordance with one or more embodiments of the present disclosure.

FIG. 7, for instance, is a top plan view of an example catch mechanism 736. In this particular embodiment, the catch mechanism 736 includes a retention ring 738 coupled to an elongate member 740. The retention ring 738 may be formed of a solid body and may have one or more openings 750 formed therein. The openings 750 may pass axially/longitudinally through the retention ring 738. In at least some embodiments, a surface area of the openings 750 is sufficient to allow drilling fluid to pass through the openings 750 and to a downhole mill, bit, or other tool.

In the illustrated figure, the openings 750 are shown as being located radially between an outer perimeter 752 and an inner bore 754 of the retention ring 738. As discussed herein, the outer perimeter 752 may be sized, shaped, or otherwise configured to allow optional axial movement within a downhole tool. The downhole tool may also restrict axial movement (e.g., using a shoulder or restriction) of the retention ring 738. The inner bore 754 may be sized, shaped, and otherwise configured to allow the elongate member 740 to be at least partially positioned therein, and coupled thereto.

The embodiment shown in FIG. 7 illustrates an example in which three (3) openings 750 are provided to allow drilling fluid to flow through the retention ring 738. The three (3) openings may be angularly offset around the retention ring 738 at equal or unequal intervals, and may have any suitable shape. The illustrated openings 750 are shown as having arcuate shapes offset at equal angular offsets of 120° from center-to-center. In other embodiments, however, the openings 750 may be circular, square, hexagonal, or have other regular or irregular shapes. Moreover, while three (3) openings 750 are shown, other embodiments are contemplated in which there are between one (1) and twenty (20) openings. For instance, the number of openings may be within a range having a lower limit, an upper limit, or both lower and upper limits that include any of one (1), two (2), three (3), four (4), five (5), six (6), eight (8), twelve (12), sixteen (16), twenty (20), or any values therebetween. In still other embodiments, there may be more than twenty (20) openings. Further, there may also be less than one (1) opening. For instance, one or more grooves along the outer perimeter 752 may allow fluid to flow past, but not through, the retention ring 738. In another embodiment, the body of a downhole tool may be modified to allow fluid flow to flow around the retention ring 738. For instance, a passageway may be formed radially into the body of the downhole tool. The passageway may also extend axially downward past the retention ring 738 and then re-join with a central bore.

FIG. 7 also illustrates symmetric and equally spaced openings 750; however, one or more openings 750 may be asymmetrical, or unequally spaced. For instance, the center-to-center spacing between adjacent openings 750 may be between 15° and 240° in some embodiments. As an example, the center-to-center spacing between one or more pairs of adjacent openings (and potentially between each pair of adjacent openings) may be within a range having a lower limit, an upper limit, or both lower and upper limits that include any of 15°, 30°, 45°, 60°, 75°, 90°, 105°, 120°, 135°, 150°, 165°, 180°, 195°, 210°, 225°, 240°, or any values therebetween. In still other embodiments, spacing between pairs of adjacent openings may be less than 15° or more than 240°. While FIG. 7 also illustrates an example embodiment in which each opening 750 is at the same radial position, other embodiments also contemplate positioning openings at different radial positions within the retention ring 738.

Figure 8:
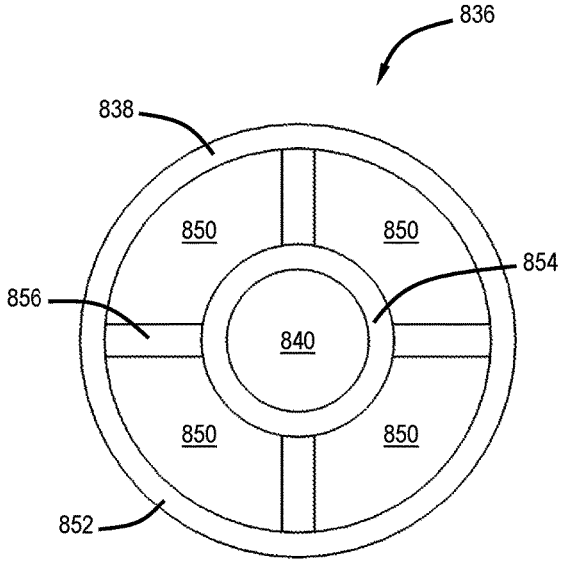
FIG. 8 is a top view of another catch mechanism for use as a secondary connection between a drive mechanism and a bit, in accordance with one or more embodiments of the present disclosure.

The catch mechanism 736 is a non-limiting example of one assembly or tool that may be used to allow fluid to flow therethrough for use in a downhole tool. FIG. 8 illustrates still another embodiment of a catch mechanism 836 that may also allow fluid flow therethrough. In particular, the catch mechanism 836 may include a retention ring 838 having an outer ring 852 coupled to an inner ring 854 by one or more baffles 856. The space between the baffles 856 may define openings 850 that operate as fluid channels for fluid to pass through the retention ring 838. In this embodiment, the baffles 856 are shown as being generally rectangular, and the openings 850 are rounded trapezoids; however, the baffles 856 and openings 850 may be otherwise shaped and configured. The inner ring 854 may also be used to couple the retention ring 838 to an elongate member 840 or other component that may be coupled to a mill, bit, or other tool.

The retention ring 836 may be formed of a single material and machined, molded, or otherwise formed. In other embodiments, the outer and inner rings 852, 854 may be separate components coupled together by the baffles 856. In some embodiments, the outer and inner rings 852, 854 may cooperate to define a journal, bearing, bushing, or the like to allow the elongate member 840 to rotate relative to at least a portion of the retention ring 838 (e.g., the outer ring 852), or to allow the retention ring 838 to rotate relative to a downhole tool or other component to which it is coupled.

Tools, systems, methods, and processes in which embodiments of the present disclosure may be used will be apparent from the description herein. For instance, in some embodiments, a milling assembly includes a mill and a drill string coupled to the mill. The drill string may support a full weight of the mill. A catch mechanism may be coupled to the mill and configured to at least partially support the weight of the mill after failure of a connection between the mill and the drill string. In the same or other embodiments, the catch mechanism may include a rod or tube (or both) coupled to the mill and configured to support the full weight of the mill when in tension after failure of the connection between the mill and the drill string. Optionally, the drill string may define a first load path supporting the full weight of the mill before failure of the connection between the mill and the drill string. The drill string and catch mechanism can collectively define a second load path supporting the full weight of the mill after failure of the connection between the mill and the drill string.

Figure 9:
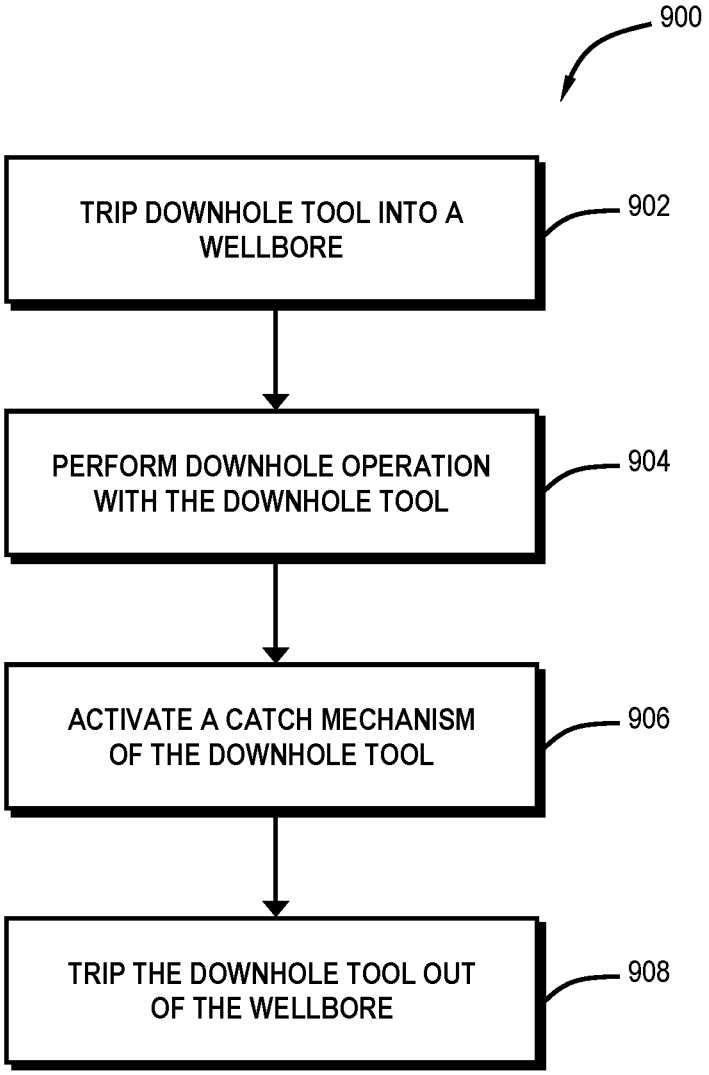
FIG. 9 is a flow chart of an example method for retrieving a downhole too, in accordance with one or more embodiments of the present disclosure.

FIG. 9 also illustrates an example embodiment of a method 900 in a downhole environment in which a downhole tool is to be retrieved. As discussed herein, other embodiments are, however, contemplated which are outside of a downhole or oilfield environment. In FIG. 9, the method 900 may include tripping a downhole tool into a wellbore at 902. The downhole tool may include any number of components, assemblies, or the like, as discussed herein. In some embodiments, the downhole tool may include a bit (e.g., a mill, drill bit, etc.) and a drive mechanism coupled to the bit. The drive mechanism may include a drill string rotated from a surface of the wellbore, a drill string or drive shaft rotated by a downhole component such as a downhole motor, or another drive mechanism used to rotate or otherwise move the bit. A catch mechanism may also be coupled to the bit. In some embodiments, the catch mechanism may also be coupled to the drive mechanism.

When the downhole tool is in the wellbore, a downhole operation may be performed with the downhole tool at 904. The downhole operation may include, for instance, using a drill bit to drill a primary wellbore or lateral borehole. The downhole operation may include using a mill to initiate a lateral borehole or to form a window in casing for allowing formation of a lateral borehole. Other reaming, section milling, anchoring, or other operations may also be performed. For instance, a bit may be coupled to a whipstock for a single-trip wellbore departure or sidetracking system. A downhole operation performed with the tool may include orienting or anchoring the whipstock (or both orienting and anchoring the whipstock) within the wellbore.

During the downhole operation performed at 904, the bit or other components of the downhole tool may be supported along a first load path. For instance, a drill string or other drive mechanism may define or be included in a load path that supports the bit. Optionally, the catch mechanism of the downhole tool may be inactive or may not support a full or even partial weight of the bit during the downhole operation.

Before, after, or during performance of the downhole operation at 904, the catch mechanism of the downhole tool may be activated at 906. In some embodiments, activating the catch mechanism may include transitioning the catch mechanism from an inactive state to an active state. Such transition may occur automatically or in response to a command, single, or input. For instance, during the downhole operation performed at 904 or the trip-in process at 902, the downhole tool may break or fail. This may include a failure of a connection between the bit and the drive mechanism. Such failure may occur directly at the point of a connection or along the drive mechanism. In such an event, the catch mechanism may be automatically activated. In other embodiments, a wireless signal, pressure pulse, or other command from surface may be sent to activate the catch mechanism at 906.

Activating the catch mechanism at 906 may be performed in any number of ways, and may include changing the load path for supporting the weight of the bit. For instance, a second load path may become active upon activating the catch mechanism. The load path may pass through the catch mechanism, which may support a full or partial portion of the bit and potentially components that remain coupled to the bit. In some embodiments, the load path after activation of the catch mechanism may pass from the catch mechanism and to a portion of the drive mechanism. For instance, the catch mechanism may be coupled to the drive mechanism. The catch mechanism may fully support the weight of the bit, and the drive mechanism may in turn fully support the weight of the catch mechanism and the bit. Accordingly, the catch mechanism and drive mechanism may collectively support the weight of the bit. Optionally, activating the catch mechanism at 906 may include placing the catch mechanism in tension by, for instance, suspending the bit from the catch mechanism.

The downhole tool may also be tripped out of the wellbore at 908. In some embodiments, the downhole tool may be tripped out of the wellbore while the first load path supports the weight of the bit. For instance, if the catch mechanism is not activated, the same load path used by the downhole tool during performance of the downhole operation at 904 and the trip-in process at 902 may be used during the trip-out process at 908. In other embodiments, however, the catch mechanism may be activated at 906. Where tripping the downhole tool out of the wellbore at 908 after activating the catch mechanism at 906, a second or redundant load path through the catch mechanism may be used to support the weight of the bit and maintain the bit coupled to the drive mechanism. In some embodiments, two connections may be present between the bit and the drive mechanism when the first load path is active (e.g., one between the drive mechanism and bit which bypasses the catch mechanism, and another which is through the catch mechanism). After activating the catch mechanism, some embodiments contemplate a single connection between the bit and the drive mechanism (e.g., one between the drive mechanism and the bit through the catch mechanism).

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation or illustrated position relative to one or more other components. Relational terms do not indicate a particular orientation for each embodiment within the scope of the description or claims. For example, a component of a bottomhole assembly that is described as "below" another component may be further from the surface while within a vertical wellbore, but may have a different orientation during assembly, when removed from the wellbore, or in a deviated or other lateral borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional or other element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple,"

"coupled," "connect," "connection," "connected," "in connection with," and "connecting" refer to "in direct connection with," or "in connection with via one or more intermediate elements or members." Components that are "integral" or "integrally" formed should be interpreted to include components of unitary construction made from the same piece of material, or sets of materials, such as by being commonly molded or cast from the same material, or machined from the same one or more pieces of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in any combination. Features and aspects of methods described herein may be performed in any order.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, assemblies, methods, milling systems, and other components of the present disclosure, or which would be appreciated in view of the disclosure herein, may be used in other applications and environments. In other embodiments, milling tools, drilling tools, catch mechanisms, retrieval or recovery systems, methods of milling, methods of drilling, methods of retrieving a tool, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide a lower limit, an upper limit, or both lower and upper limits. Any of the numerical values may be provided as a range using a single value (e.g., up to 50% or at least 50%) or as a range using two values (e.g., between 40% and 60%). Any single, particular value within the range is also contemplated. Numbers, percentages, ratios, measurements, or other values stated herein are intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 10%, within 5%, within 1%, within 0.1%, or within 0.01% of a stated value.

The Abstract included with this disclosure is provided to allow the reader to quickly ascertain the general nature of some embodiments of the present disclosure. The Abstract is submitted with the understanding that it will not be used to interpret or limit the scope or meaning of the claims.

What is claimed is:

1. A tool, comprising:

a bit;

a first load path that includes a weld between a tubular member and the bit; and a second load path that includes a connector that is connected to the inside of the bit, where the connector is axially fixed relative to the bit when the weld is in place and when it breaks, but is axially movable relative to the tubular member only when the weld is broken, such that the connector is in an inactive state before failure of the weld and an active state after failure of the weld.

2. The tool of claim 1, the bit including a mill.

3. The tool of claim 1, the first load path including a drill string coupled to the tubular member.

4. The tool of claim 3, the connector including a catch mechanism inside the drill string.

5. The tool of claim 4, the catch mechanism including at least one of a bushing, bearing, or journal having a fluid path therethrough.

6. The tool of claim 5, the catch mechanism including an elongate member coupled to the bit.

7. The tool of claim 1, the second load path being rotatable within the drill string.

8. The tool of claim 1, the second load path being axially movable within the first load path.

9. The tool of claim 8, the second load path being configured to move axially within the first load path after the first load path is decoupled from the bit.

10. A downhole tool, comprising:

a bit;

a drill string having a distal end coupled to the bit, the drill string includes a weld between the drill string and the bit; and a catch mechanism coupled to the bit inside the bit and configured to support the bit at least after failure of the drill string or a connection between the drill string and the bit the catch mechanism being in an inactive state before failure of the drill string or the connection between the drill string and the bit, and an active state after failure of the drill string or a connection between the drill string and the bit.

11. The downhole tool of claim 10, the drill string providing a first load path, and the catch mechanism providing a redundant load path.

12. The downhole tool of claim 10, the catch mechanism being configured to be in tension in the active state.

13. The downhole tool of claim 10, the catch mechanism being configured not to be in tension before failure of the drill string or the connection between the drill string and the bit.

14. The downhole tool of claim 10, the catch mechanism being coupled to the drill string above a failure location.

15. A method for retrieving a downhole tool, comprising:

tripping a downhole tool into a wellbore, the downhole tool including:

a bit;

a drive mechanism coupled to the bit; and a catch mechanism coupled to the bit inside the bit;

performing a downhole operation with the downhole tool while the drive mechanism supports the bit and while the catch mechanism is in an inactive state;

activating the catch mechanism upon failure of a connection between the drive mechanism and the bit; and tripping the downhole tool out of the wellbore.

16. The method of claim 15, wherein performing the downhole operation includes fully supporting a weight of the bit with the drive mechanism.

17. The method of claim 15, wherein tripping the milling assembly out of the wellbore includes suspending the bit from the catch mechanism, the catch mechanism being coupled to the drive mechanism.

* * * * *